US008839582B2

(12) United States Patent
Aboukhalil

(10) Patent No.: US 8,839,582 B2
(45) Date of Patent: Sep. 23, 2014

(54) WAINSCOT WALL PANEL SYSTEM

(76) Inventor: Charbel Tannious Aboukhalil, Grand Terrace, CA (US)

( * ) Notice: Subject to any disclaimer, the term of this patent is extended or adjusted under 35 U.S.C. 154(b) by 114 days.

(21) Appl. No.: 13/118,937

(22) Filed: May 31, 2011

(65) Prior Publication Data

US 2012/0304568 A1 Dec. 6, 2012

(51) Int. Cl.
*E04B 2/00* (2006.01)
*E04F 19/06* (2006.01)
*E04F 19/02* (2006.01)

(52) U.S. Cl.
CPC ..... *E04F 19/022* (2013.01); *E04F 19/061* (2013.01); *E04F 19/065* (2013.01); *E04F 19/064* (2013.01); *E04F 19/062* (2013.01)
USPC ..... 52/506.05; 52/466; 52/460

(58) Field of Classification Search
CPC ..... E04F 19/022; E04F 19/06; E04F 19/02; F16B 12/02
USPC ..... 52/506.05, 716.8, 465, 466, 460
See application file for complete search history.

(56) References Cited

U.S. PATENT DOCUMENTS 2,947,093 A * 8/1960 Masters ..... 434/421
5,220,763 A * 6/1993 Armitage ..... 52/461
5,598,667 A * 2/1997 Dykes ..... 52/71
5,661,937 A * 9/1997 Doppler et al. ..... 52/410
5,694,727 A * 12/1997 Dobija ..... 52/506.01
6,170,214 B1 * 1/2001 Treister et al. ..... 52/511
6,308,486 B1 * 10/2001 Medland ..... 52/506.05
6,510,635 B1 * 1/2003 Rudolph et al. ..... 40/658
6,591,575 B2 * 7/2003 Benedettini ..... 52/716.1
7,562,504 B2 * 7/2009 Herbst et al. ..... 52/461
8,347,577 B2 * 1/2013 Aboukhalil ..... 52/489.1
2006/0070329 A1 * 4/2006 Schiltz ..... 52/506.01
2009/0313935 A1 * 12/2009 Montgomery ..... 52/506.1
2010/0251647 A1 * 10/2010 Enns ..... 52/302.1
2012/0302573 A1 * 11/2012 Jackson et al. ..... 514/249
2013/0091800 A1 * 4/2013 Aboukhalil ..... 52/716.8

* cited by examiner

*Primary Examiner* — Branon Painter
(74) *Attorney, Agent, or Firm* — Stetina Brunda Garred & Brucker

(57) ABSTRACT

The wainscot wall panel system may comprise a plurality of panels which are mounted to a wall. The plurality of panels are mounted to the wall with a plurality of horizontal joints including but not limited to a bottom edge joint and a top edge joint and one or more intermediate or middle horizontal joints. Each of the joints are attached to the wall and used to mount the panel to the wall. In particular, the joints may have panels which mechanically receive the panels so that no adhesive or chemical attachment methods are necessary in order to mount the panels to the wall. This reduces the exposure of toxic chemicals to the occupants of the building and permits air to flow behind the panels, thereby mitigating the creation of mold.

12 Claims, 10 Drawing Sheets

WAINSCOT WALL PANEL SYSTEM

CROSS-REFERENCE TO RELATED APPLICATIONS

Not Applicable

STATEMENT RE: FEDERALLY SPONSORED RESEARCH/DEVELOPMENT

Not Applicable

BACKGROUND

The embodiments disclosed herein relate to a wainscot wall panel system.

Prior art wainscot wall panel system utilize adhesive to mount a plurality of panels to the wall. In particular, a plurality of panels may be adhered to the wall. Unfortunately, utilizing adhesive to mount the panels to the wall prohibits or reduces the amount of air that can flow behind the panels. Moisture may be trapped behind the panels which may cause mold to grow behind the panels and also warp the panels due to the uneven humidity between the front and back sides of the panels. The mold problem is particularly important to resolve in buildings where people will reside for long periods of time such as hospitals and schools.

Prior art wainscot wall panel systems have attempted to mount panels to the wall without adhesive. However, the prior art has utilized excessively thick panels of about ½" or more. This has a detrimental visual effect on the wainscot.

Accordingly, there is a need in the art for an improved wainscot wall panel system.

BRIEF SUMMARY

The embodiments disclosed herein address the deficiencies discussed above, discussed below and those that are know in the art.

A wainscoting panel system disclosed herein may comprise a plurality of panels arranged in series of stacked rows and columns. These panels are mounted to a wall with a plurality of horizontal joints, bottom joint and wainscot cap which are attached to the wall. Each of the joints and cap may have at least one channel that receives one or more panels to mechanically attach the panels to the wall. No adhesive is utilized to secure the panel(s) to the joints or the wall. Air is able to flow behind the panels and mitigate moisture buildup. Moreover, this beneficially reduces the chances of mold growth or warpage of the panels.

The embodiments of the wainscot wall panel system disclosed herein are a clipless system. Clips are not attached to the back side of the panels. Moreover, the panels are relatively thin. For example, the panels may be about ¼" thick phenolic yet still be sufficiently rigid. This minimizes the thickness of the wainscot wall panel system when installed on the wall and improves its aesthetic appeal.

More particularly, a wainscoting panel system for a wall is disclosed. The system may comprise a plurality of panels and a plurality of vertical and horizontal joints. The plurality of rigid panels may have a thickness of about ¼" or less. The plurality of vertical and horizontal joints may be attached to the wall to mount the panels to the wall as rows and columns of panels. The vertical and horizontal joints may have channels. A width of the channel may be equal to or greater than the thickness of the rigid panels so that the entire panel can be inserted into the channels for mounting the panels to the wall.

The panels may be fabricated from an eco friendly material such as phenolic sheets or other suitable material. The panels may be rectangular but may also have other configurations (e.g., octagonal, hexagonal, pentagonal, circular, triangular, etc.).

The horizontal joints may be configured as a bottom edge joint. The bottom edge joint has a base. A plurality of screws may be screwed into the base and the wall for attaching the bottom edge joint to the wall. The bottom edge joint may also have front and rear retaining walls which define the channel that receives the panel.

The horizontal joint may also be configured in the following manner. The horizontal joint may include a horizontal wall clip and a horizontal guide. This horizontal joint may be disposed between two stacked rows of panels. The horizontal wall clip has a base and an upwardly directed groove. The horizontal guide has a downwardly directed tongue which is received into the upwardly directed groove for attaching the horizontal guide to the horizontal wall clip. The horizontal wall clip and the horizontal guide collectively define upper and lower channels for receiving upper and lower panels for the purposes of vertically stacking the panels. The upper and lower channels defined by the horizontal wall clip and the horizontal guide may have a width which is greater than or equal to the thickness of the panels so that the entire panel can be inserted into the channel. The tongues and grooves may be attached in the following manner. The tongue of the horizontal guide and the groove of the horizontal wall clip may have ribs. The tongue may be loosely fitted in the groove. Silicone may initially be disposed within the ribbed grooves. The tongue is then inserted into the groove. The silicone flows between the ribs of the tongue and groove. After the silicone is cured, the cured silicone holds the horizontal guide to the horizontal wall clip. The upper and lower channels defined by the horizontal wall clip and the horizontal guide have a width which is greater than or equal to the thickness of the panels.

At the top of the wainscot of the stacked rows of panels, a wainscot cap may be attached to the uppermost row of panels. The wainscot cap may include a horizontal wall clip and an upper cap. The horizontal wall clip may have a base and an upwardly directed groove. The upper cap may have a downwardly directed tongue which is received into the upwardly directed groove. The horizontal wall clip and the upper cap collectively define a lower channel for receiving a lower panel to finish the wainscot panel system. The tongue of the upper cap and the groove of the horizontal wall clip may have ribs. The tongue is sized so as to be loosely fitted in the groove. Silicone may be disposed between the ribbed tongues and ribbed grooves to hold the upper cap to the horizontal wall clip after the silicone is cured as discussed herein.

Additionally, a method for installing a wainscot panel system to a wall is disclosed. The method may comprise the steps of attaching a bottom edge joint to the wall; attaching a first horizontal wall clip to the wall above and parallel to the bottom edge joint; inserting a first row of panels into a channel of the bottom edge joint; attaching a first horizontal guide to the first horizontal wall clip and capturing the first row of panels in a lower channel defined by the first horizontal wall clip and the first horizontal guide; optionally, adding at least one more row of panels and horizontal wall clip; and attaching an upper cap to the uppermost horizontal wall clip and capturing the uppermost row of panels in a lower channel defined by the uppermost horizontal wall clip and the upper cap.

In the method, the steps of attaching the first horizontal guide to the first horizontal wall clip and attaching the upper cap to the uppermost horizontal wall clip may include the steps of providing a ribbed groove on the horizontal wall clip and ribbed tongue on the horizontal guide and the upper cap, the ribbed tongue is loosely fitted to the ribbed groove; disposing silicone into a groove of the horizontal wall clip; inserting a tongue of the horizontal guide into the groove of the horizontal wall clip; flowing silicone between ribs of the protrusion and tongue; and curing the silicone.

The method may further comprise the steps of providing a vertical joint defining lateral channels; and inserting vertical edges of adjacent panels into the lateral channels.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
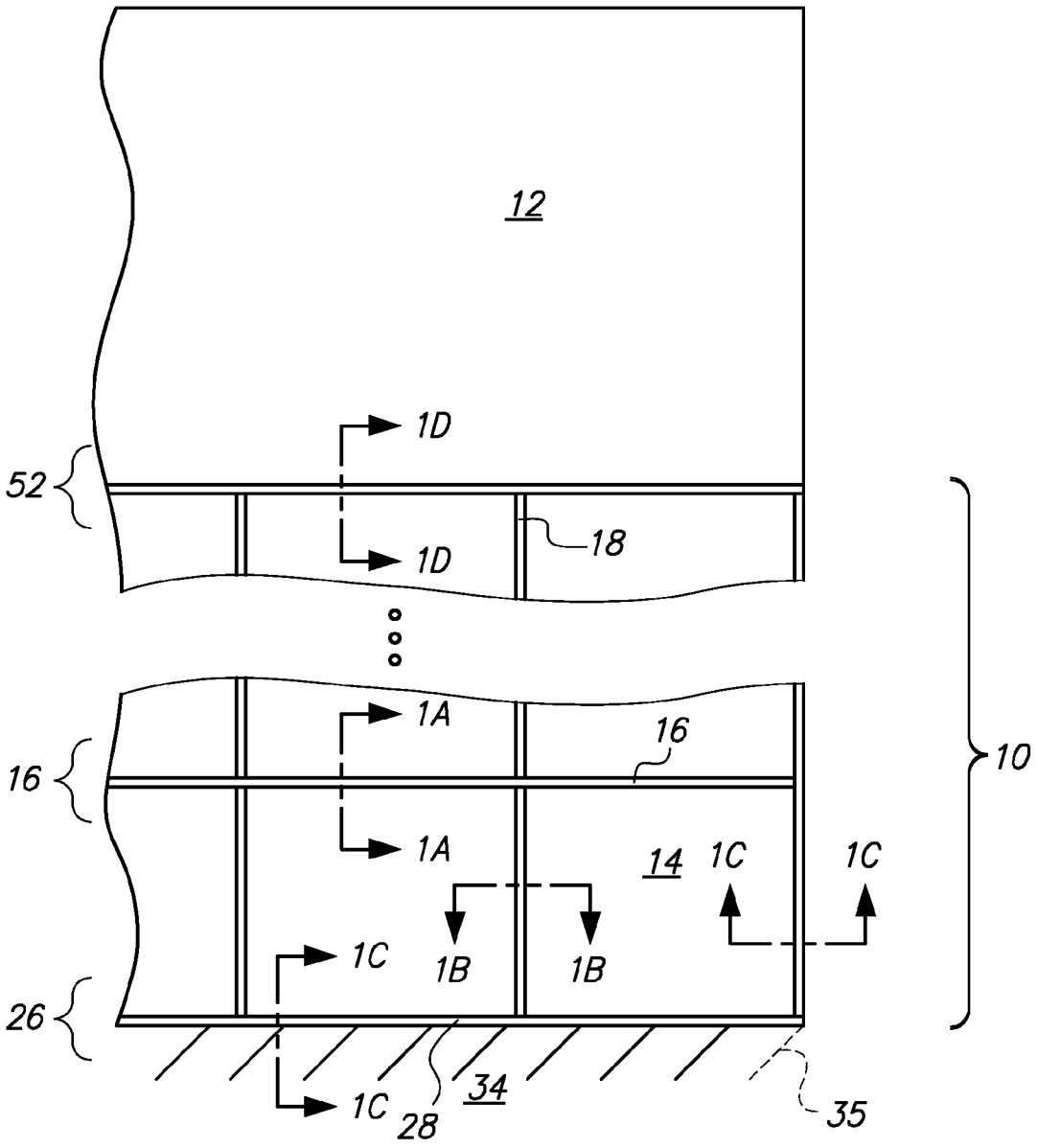
FIG. 1 is a plan view of a wainscot wall panel system.

Referring now to the drawings, a wainscoting wall panel system 10 is shown. The system 10 may be mounted to a wall 12 without utilizing glue or panel clips so that air is allowed to flow behind panels 14 of the system 10. This prevents warping of the panels 14 due to uneven moisture levels between the front and backsides of the panels 14 and prevents mold growth due to moisture that might be trapped behind the panels 14. Also, occupants will not be exposed to toxic adhesive as in prior art systems. More particularly, the system 10 comprises a plurality of horizontal and vertical joints 16, 18. These horizontal and vertical joints 16, 18 have channels 20, 22 (see FIGS. 1A, 1B) that receive the panels 14. Since glue is not used in the channels, air is allowed to flow between the wall 12 and the panels 14 to the space behind the panels 14. This is shown by airflow lines 24. (see FIGS. 1A and 1B). The panels 14 may be fabricated from a thin rigid sheet material such as phenolic or other like material being generally rigid at a thickness of about ¼". Preferably, the panels 14 are thin (e.g., ¼" thick) to minimize the space taken up by the wainscot wall panel system 10. Also, preferably, the panels 14 are fabricated from phenolic so that the panels 14 can still be sufficiently rigid even though a panels 14 are only a ¼" thick. The wainscot wall panel system 10 provides for a mechanical attachment of the panel 14 to the wall 12 and not a chemical attachment such as with adhesive to reduce the amount of toxic material used in buildings. Moreover, the panels 14 are clip-less.

Figure 1A:
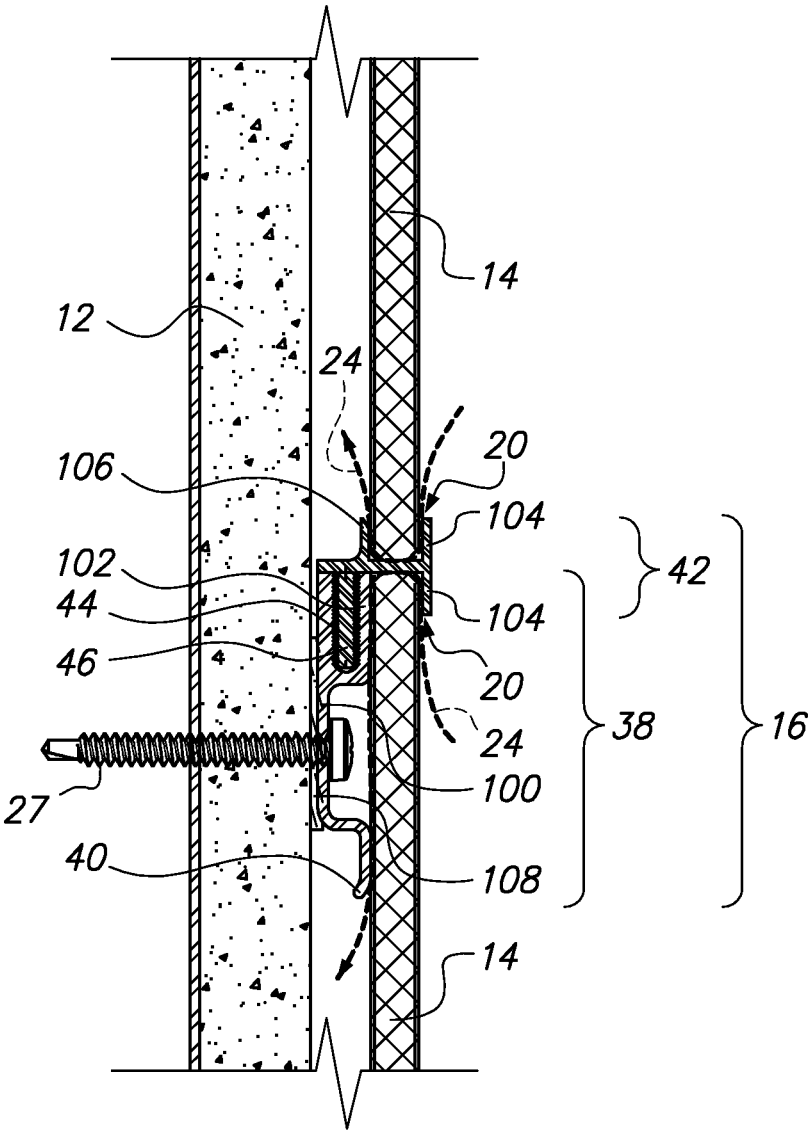
FIG. 1A is a cross sectional view of a horizontal joint of the system shown in FIG. 1.
Figure 1B:
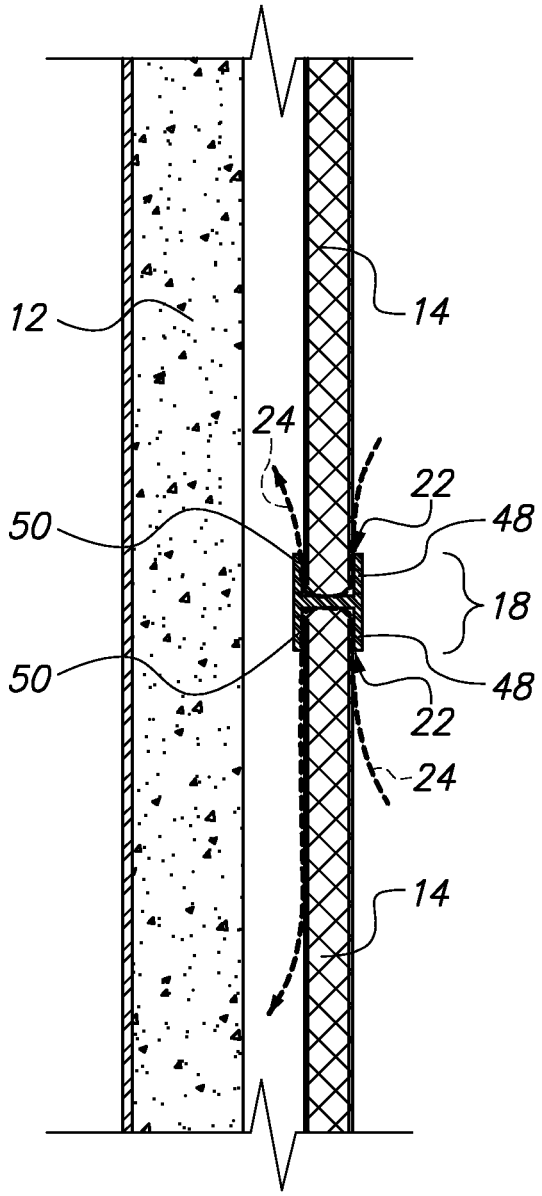
FIG. 1B is a cross sectional view of a vertical joint of the system shown in FIG. 1.
Figure 1C:
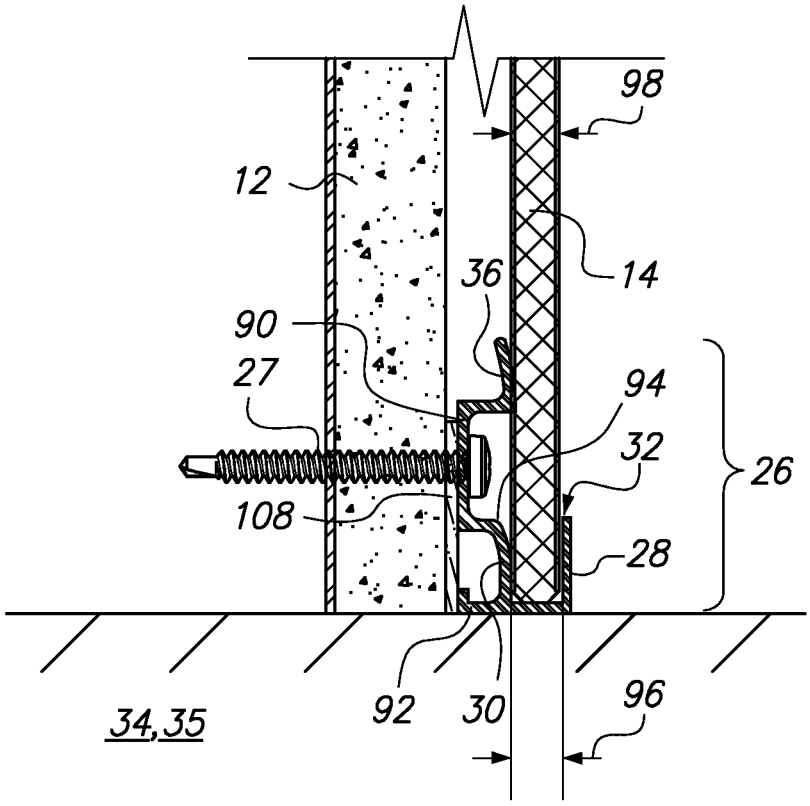
FIG. 1C is a cross sectional view of a bottom edge joint of the system shown in FIG. 1.

Referring now to FIGS. 1 and 1C, an edge joint 26 along the bottom edge of the bottom most row of panels 14 is shown. The edge joint 26 is attached to the wall 12 with one or more screws 27. The edge joint 26 may be an extruded part fabricated from aluminum or the like. The screws 27 may be attached to a base 90 of the edge joint 26. The base 90 and the retaining wall 30 may be offset from each other so that the panel 14 is gapped or spaced away from the wall 12. The gap between the panel 14 and the wall 12 may be about ⅛". The edge joint 26 additionally has a leg 92 which further adds stability to the edge joint 26. The leg 92 is supported by the wall 12. The edge joint 26 has front and rear retaining walls 28, 30 which define a channel 32. The channel 32 receives the panel 14. The edge joint 26 is an extruded part and preferably runs the length of the width of one or more of the panels 14. Preferably, the edge joint 26 runs the entire length of the bottom most row of panels 14, as shown in FIG. 1. The edge joint 26 is preferably leveled horizontally and mounted closely adjacent to or abutting the ground 34. After the edge joint 26 is mounted to the wall 12, the panels 14 may be inserted into the channel 32. The edge joint 26 additionally has a deflector 36 located above the channel 32 to guide the panel 14 into the channel 32. The deflector 36 is curved inwardly so that the deflector 36 guides the panel 14 into the channel 32 despite any minor misalignment of the panel 14 to the channel 32. The edge joint 26 additionally has a curved surface 94 which also helps to guide the panel 14 into channel 32 despite any minor misalignment of the panel 14 to the channel 32. The channel 32 defines a width 96. The panel 14 defines a thickness 98. The panel 14 may have a snug or a loose fit within the channel 32. In other words, the thickness 98 of the panel 14 may be equal to or slightly greater than the width 96 of the channel 32. As shown in FIGS. 1 and 1C, the front retaining wall 28 is exposed and visible and provides an aesthetic bottom trim to the bottom most row of panels 14.

After the bottom row of panels 14 is installed, the horizontal joint 16 is mounted to the upper edge of the bottom row of panels 14 as shown in FIG. 1A. The horizontal joint 16 may include a horizontal wall clip 38 and a horizontal guide 42. The horizontal wall clip 38 is attached to the wall 12 with one or more screws 27. The horizontal wall clip 38 may also be an extruded part and run the entire width of the wainscot (i.e., the row of panels 14). One or more screws 27 are distributed along the length of the horizontal wall clip 38 and are used to attach the horizontal wall clip 38 to the wall 12. In particular, the horizontal wall clip 38 defines a base 100. The base 100 has a plurality of holes distributed along the length of the horizontal wall clip 38. One or more screws 27 are inserted through the holes and secured to the wall 12 to attach the horizontal wall clip 38 to the wall 12. The horizontal wall clip 38 and the horizontal guide 42 collectively define the lower groove 20. In particular, the horizontal wall clip 38 has a retaining wall 102. The horizontal guide 42 has a front retaining wall 104. The retaining wall 102 of the horizontal wall clip 38 and the front retaining wall 104 of the horizontal guide 42 defines the lower channel 20. The horizontal guide 42 also has front and rear retaining walls 104, 106 which define the upper channel 20. The horizontal guide 42 is attached to the horizontal wall clip 38 by way of a tongue and groove connection. In particular, the horizontal wall clip 38 may have a ribbed groove 44. The horizontal guide 42 may have a ribbed protrusion 46. The ribbed protrusion 46 is narrower than the ribbed groove so that the ribbed protrusion 46 loosely fits within the ribbed groove 44. To attach the ribbed protrusion 46 to the ribbed groove 44, silicone is disposed in the ribbed groove 44. When the ribbed protrusion 46 is inserted into the ribbed groove 44, the silicone flows between the ribs of the protrusion 46 and groove 44. After the silicone is cured, the silicone grabs the ribs of the protrusion 46 and groove 44 to hold the horizontal guide 42 and the horizontal wall clip 38 together. The upper channel 20 of the horizontal guide 42 receives an upper row of panels 14. Additional horizontal joints 16 and panels 14 are stacked upon each other until the desired height of the wainscot has been achieved.

The horizontal wall clip 38 may have features similar to the edge joint 26 described above. In particular, the horizontal wall clip 38 may have an inwardly turned deflector 40 which guides the wall panel 14 into the lower channel 20 to account for any misalignment between the panel 14 and the lower channel 20. Moreover, the retaining wall 102 is offset from the base 100 so that the lower channel 20 may also be offset from the wall 12 and provides a gap between the wall 12 and the panel 14. The upper groove 20 is vertically aligned with the lower groove 20 so that upper and lower panels 14 provide a flat facade of panels 14. However, it is also contemplated that the upper and lower grooves 20 may be offset from each other so that the panels 14 can have a staggered effect.

As each of the panels 14 in the row of panels 14 are mounted to the wall 12, vertical joints 18 may be inserted between laterally adjacent panels 14, as shown in FIG. 1B. The vertical joints 18 have opposing vertical channels 22. These opposing vertical channels 22 are formed by respective front and rear retaining walls 48, 50. The front and rear retaining walls 48, 50 are sufficiently wide to receive the entire width of the panel 14. The panels 14 fit snuggly to slightly loose within the channels 22 and do not form an air tight seal so that air is allowed to flow between the panels 14 and channels 22 and reach behind the panels 14. The same is true for channels 20 and 32 discussed above. The panels 14 may have a snug fit with these channels 20, 32 and still allow air to flow between the panels 14 and the channels 20, 32 to reach behind the panels 14 to mitigate warping due to uneven moisture levels between the front and back sides of the panels 14.

Figure 1D:
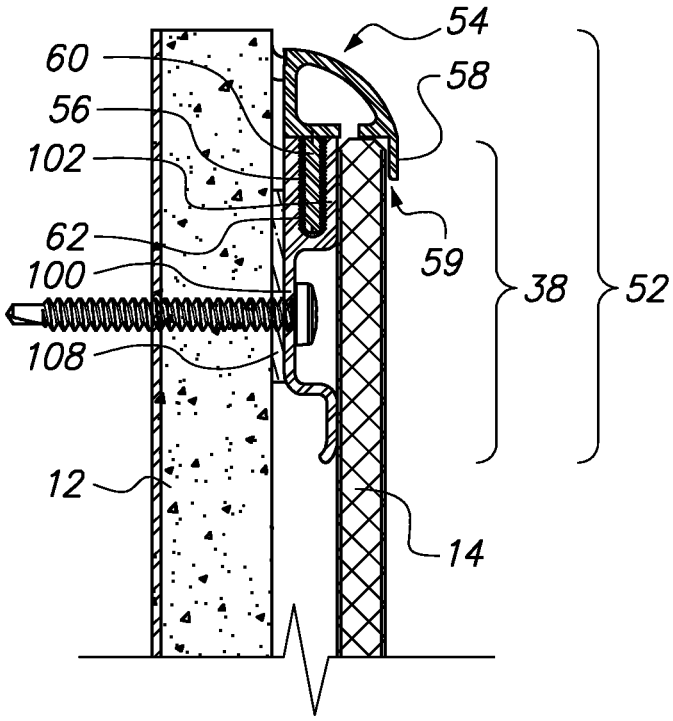
FIG. 1D is a cross sectional view of a wainscot cap of the system shown in FIG. 1.

The left and right most panels 14 may be fitted with the edge joint 26 in the same manner as discussed above in relation to the bottom edge of the bottom most row of panels 14 (see FIG. 1C). On the upper end of the wainscot, a wainscot cap 52 (see FIG. 1D) may finish the upper edge of the upper most row of panels 14. The wainscot cap 52 may comprise the horizontal wall clip 38 and an upper cap 54 that finishes the upper edge of the top row of panels 14. The horizontal wall clip 38 may be attached to the wall 12 as discussed above in relation to the horizontal joint 16. The upper cap 54 may be attached to the horizontal wall clip 38 via a tongue and groove 60, 56 with silicone as discussed herein. The retaining wall 102 and the front retaining wall 58 collectively define channel 59 and receive the panel 14.

The left and/or right sides of the wainscot may terminate at a wall or midway on a wall. The panels 14 on the left or right sides may be finished with an edge joint similar to the bottom edge of the wainscot shown in FIG. 1C. It is also contemplated that the wainscot may have other edge finishes such as when the wainscot turns an outer corner shown in FIGS. 2-4A or an inside corner shown in FIGS. 5-6A.

Figure 2:
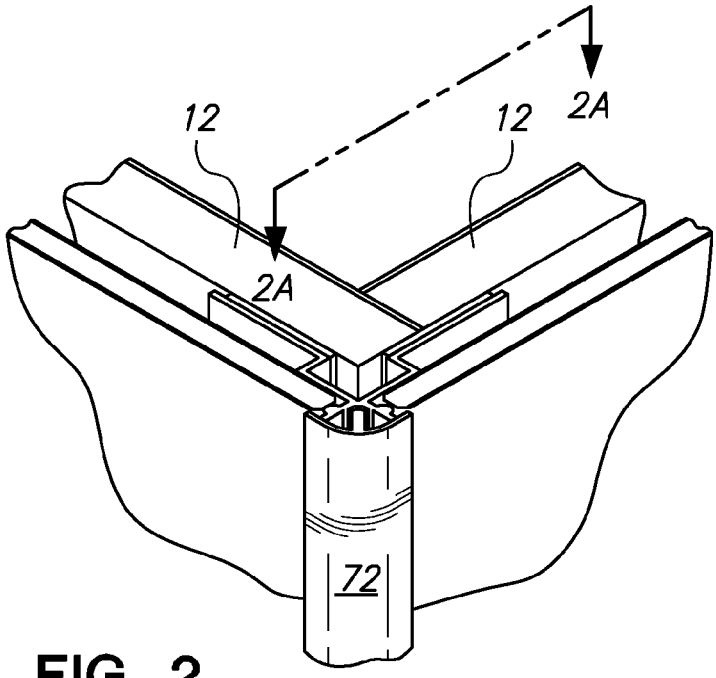
FIG. 2 is a perspective view of a first embodiment of an outside corner of the wainscot wall panel system.
Figure 2A:
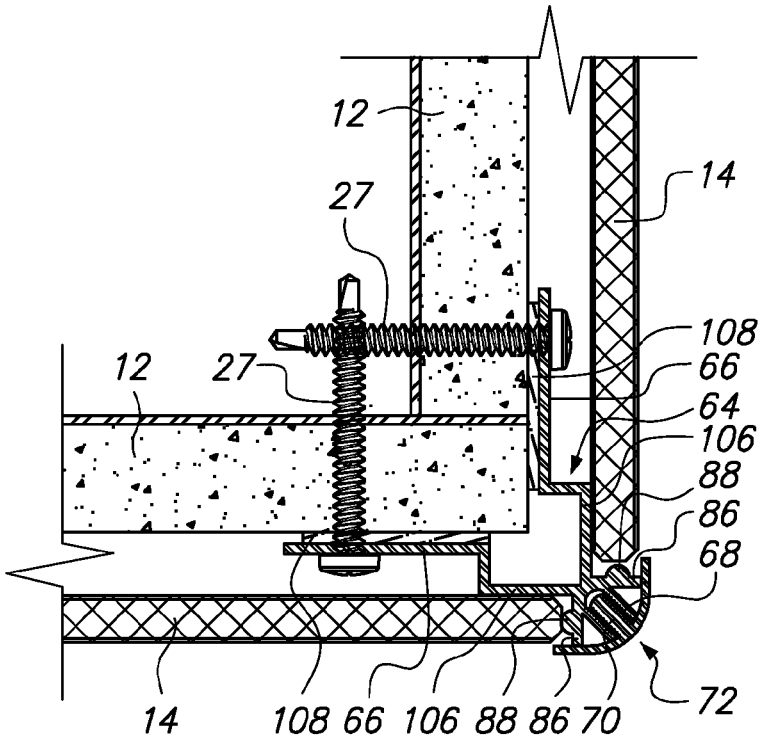
FIG. 2A is a top view of the outside corner shown in FIG. 2.

Referring now to FIGS. 2 and 2A, the outside corner may connect two perpendicular walls 12. Other angles are also contemplated. The outside corner may be protected by a corner guard 64 and cap 72. The corner guard 64 may comprise two bases 66 which mount the corner guard 64 to the walls 12 with one or more screws 27. The corner guard 64 may be an extruded part fabricated from aluminum or another similar material. The corner guard 64 may extend a height of one or more of the panels 14. One or more screws 27 are attached along the height of the corner guard 64 on the two bases 66. In the middle of the corner guard 64, a ribbed groove 68 may be formed. The ribbed groove 68 may receive a ribbed protrusion 70 of the cap 72. The ribbed protrusion 70 may be held within the ribbed groove 68 by lining the ribbed groove 68 with silicone and inserting the ribbed protrusion 70 therein. The silicone flows between the ribs of the protrusion 70 and the groove 68. After the silicone is cured, the cap 72 is retained to the corner guard 64. During use, personnel and equipment may bump and damage the cap 71. When damaged, the cap 72 may be easily replaced. The protrusion 70 is pulled out of the groove 68. The old silicone is cleaned out of the groove 68 and fresh new silicone is disposed in the groove 68. A new cap 72 is then placed on the corner guard 64 by inserting the protrusion 70 of the cap 72 into the groove 68 of the corner guard 64. The silicone is allowed to cure. The corner guard 64 may have end arms 86. Nubs 88 on the end arms 86 may regulate lateral movement of the panels 14. The ribbed groove 68 is formed with the end arms 86 and is aligned to the corner of the walls 12. The corner guard 64 may have ledges 106 that support the panels 14 from being bowed inward when hit by pedestrians and equipment that may pass along the hallway in which the wainscot is installed. The ledges 106 are offset from the bases 66 to provide for the gap between the wall 12 and the panel 14. Air is allowed to flow between the panels 14 and the corner guard 64 since glue or adhesive is not used to mount the panel 14. This mitigates warping of the panel 14 due to uneven moisture levels between the front and backsides of the panel 14 and mold growth. Also, occupants of the building are exposed to less toxic materials.

Figure 3:
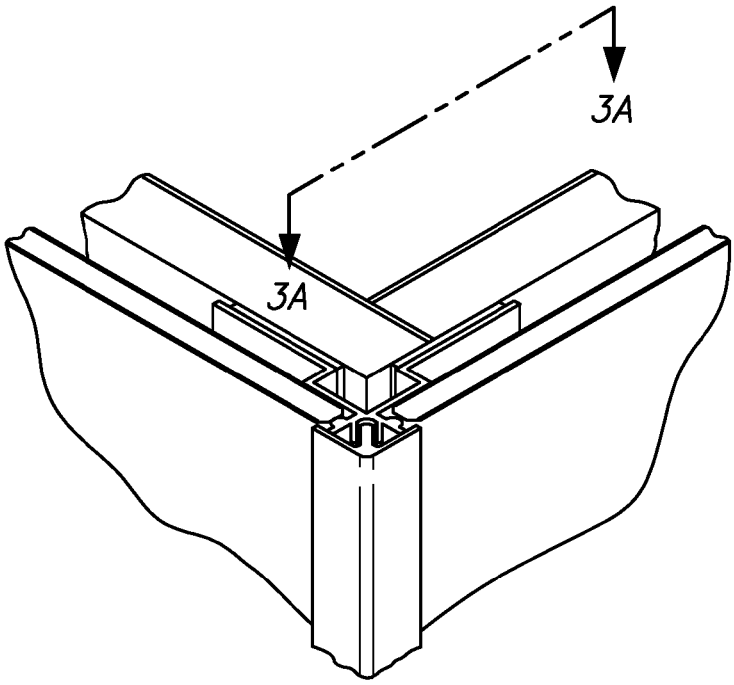
FIG. 3 is a perspective view of a second embodiment of the outside corner of the wainscot wall panel system.
Figure 3A:
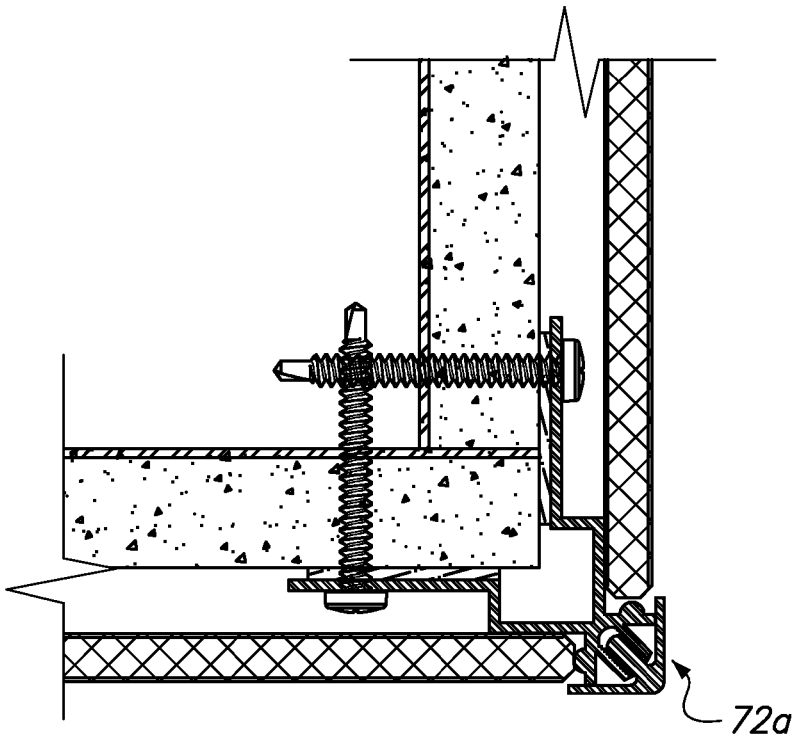
FIG. 3A is a top view of the outside corner shown in FIG. 3.
Figure 4:
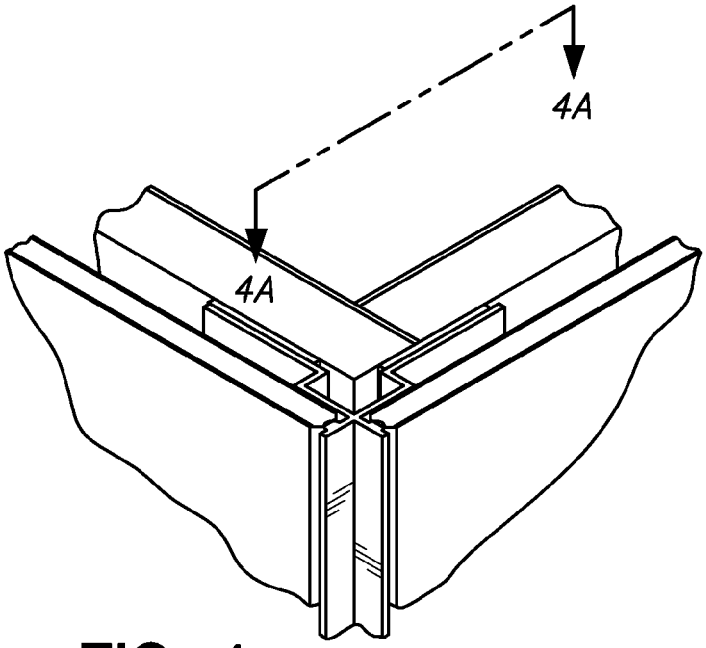
FIG. 4 is a perspective view of a third embodiment of the outside corner of the wainscot wall panel system.
Figure 4A:
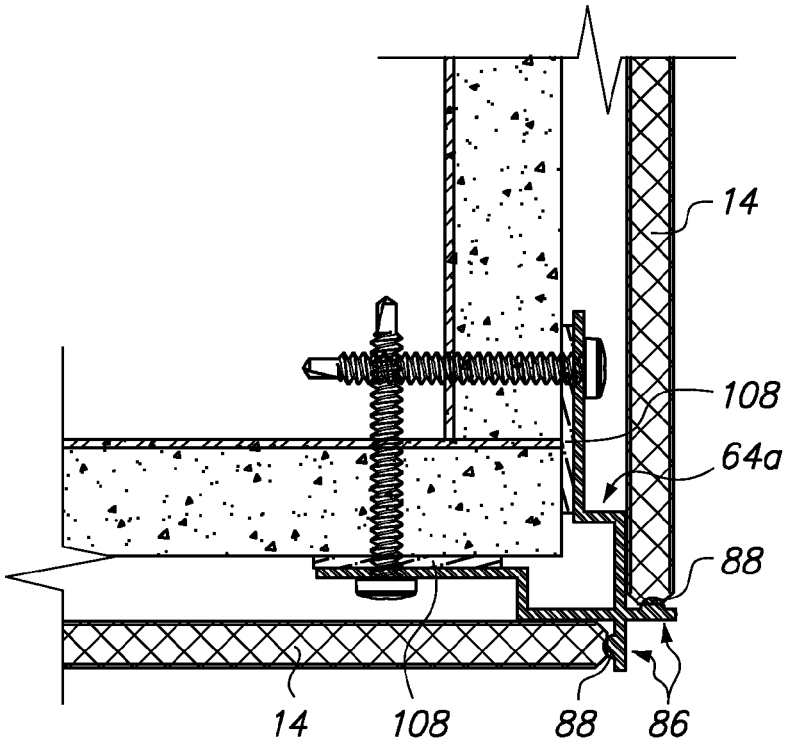
FIG. 4A is a top view of the outside corner shown in FIG. 4.

Other embodiments of the outside corner are also contemplated. By way of example and not limitation, referring to FIGS. 3 and 3A, the outside corner is identical to the outside corner shown in FIGS. 2 and 2A except that the cap 72*a* has a different configuration. The cap 72*a* has a sharper corner compared to the cap 72 shown in FIG. 2A. The third embodiment shown in FIGS. 4 and 4A does not have a cap 72. Rather, the corner guard 64 has end arms 86 with nubs 88 that regulate the lateral position of the panels 14. The panels 14 can slide laterally in channels 32, 20 and 59. The end arms 86 limit the lateral movement of the panels 14.

Figure 5:
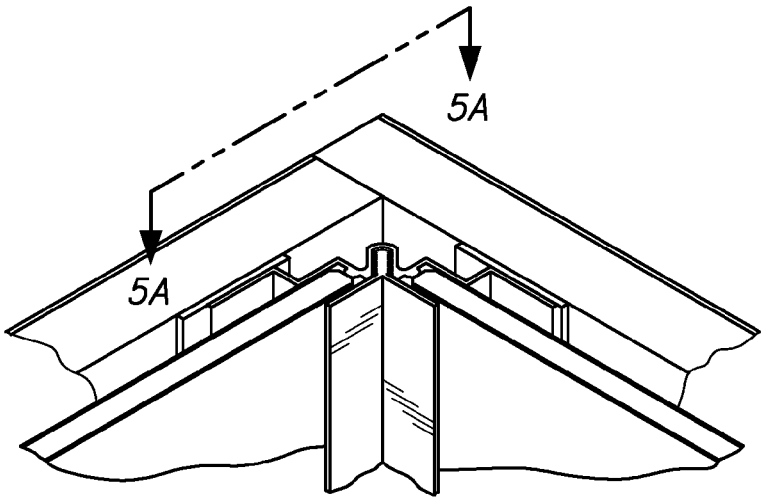
FIG. 5 is a perspective view of a first embodiment of an inside corner of the wainscot wall panel system.
Figure 5A:
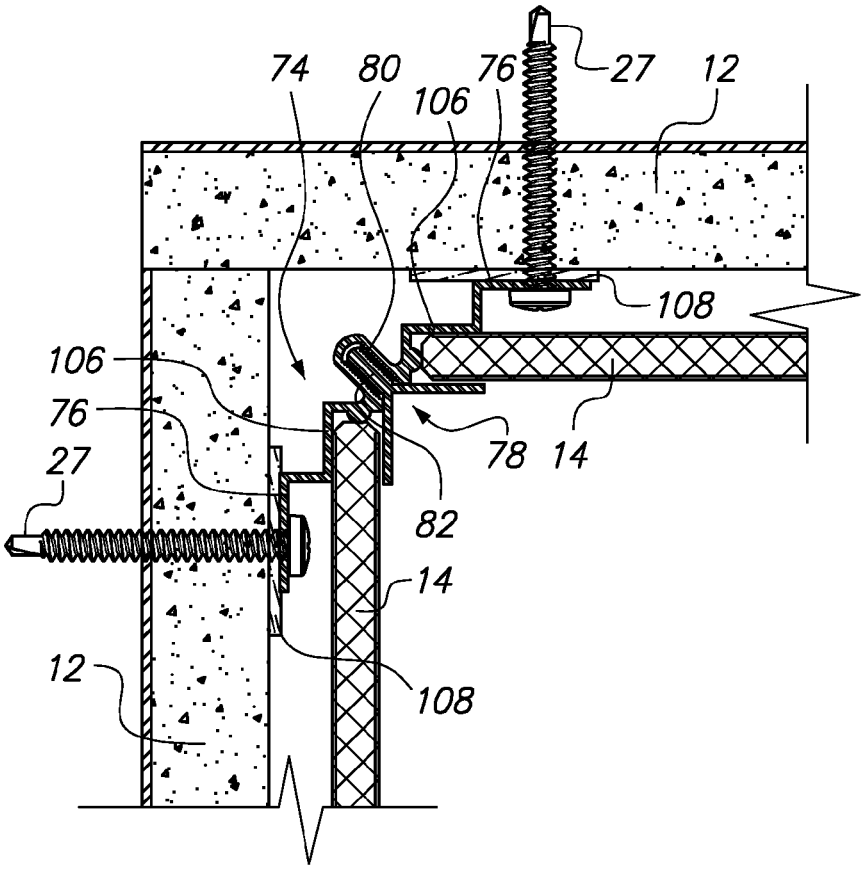
FIG. 5A is a top view of the inside corner shown in FIG. 5.

Referring now to FIGS. 5 and 5A, an inside corner is shown. The inside corner may have an inside corner guard 74 and an inside cap 78. The inside corner guard 74 may have two bases 76 that are used to mount the inside corner guard 74 to the walls 12. The inside corner guard 74 may be an extruded part fabricated from aluminum or a similar material. The two bases 76 may have a plurality of holes which are used to mount the inside corner guard 74 to the walls 12. In particular, one or more screws 27 are inserted into the holes and used to attach the bases 76 of the inside corner guard 74 to the walls 12. The panels 14 are disposed between the inside corner guard 74 and the inside cap 78. To mount the inside cap 78 to the inside corner guard 74, the inside corner guard 74 has a ribbed groove 80 which receives a ribbed protrusion 82 of the inside cap 78. Silicone may be lined within the ribbed groove 80. After the protrusion 82 is inserted into the groove 80, the silicone flows between the ribs of the protrusion 82 and the groove 80. After the silicone is cured, the inside cap 78 does not fall away from the inside corner guard 74. If the inside cap 78 is damaged, personnel may remove the inside cap 78 by pulling the inside cap 78 and breaking the silicone bond between the protrusion 82 and the groove 80. The inside corner guard 74 may additionally have ledges 106 which support the panels 14 to mitigate against inward bowing of the panels 14 in the event that the panels 14 are hit by a pedestrian or object. The ledges 106 are offset from the bases 76 to provide for a gap between the walls 12 and the panel 14.

Figure 6:
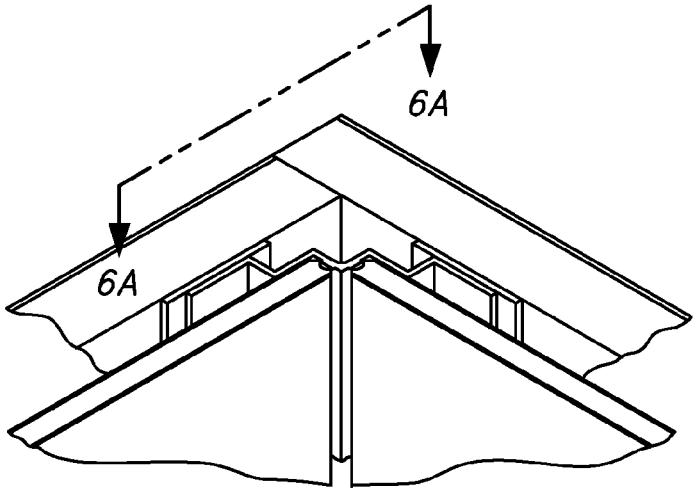
FIG. 6 is a perspective view of a second embodiment of the outside corner of the wainscot wall panel system.
Figure 6A:
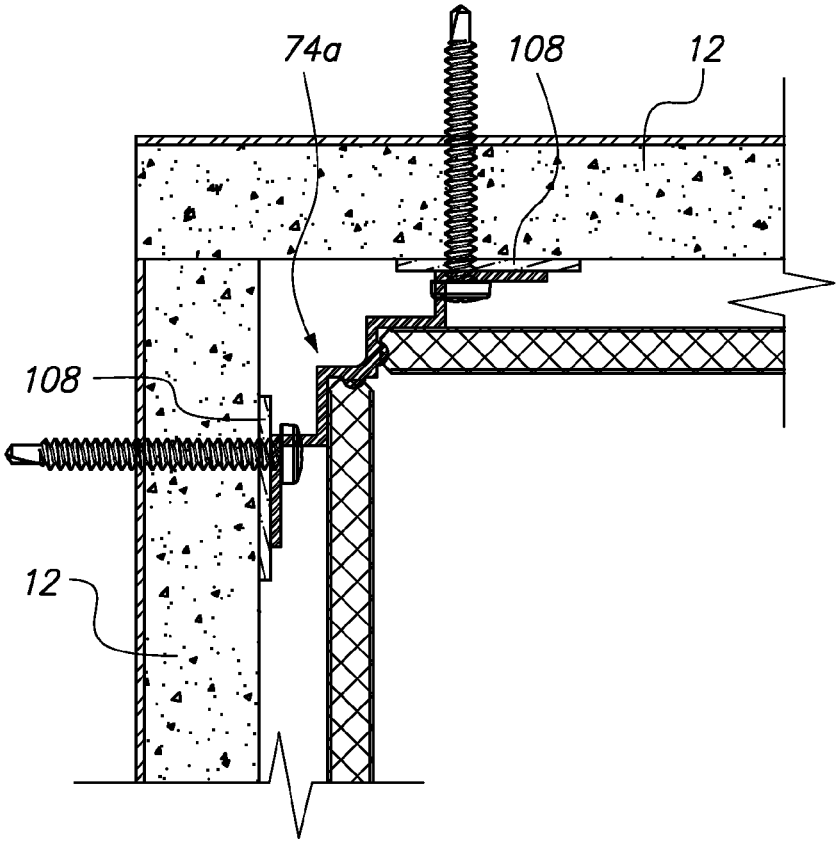
FIG. 6A is a top view of the outside corner shown in FIG. 6.

Other embodiments of the inside corner are also contemplated. By way of example and not limitation, an alternate embodiment of the inside corner is shown in FIGS. 6 and 6A. In particular, the inside corner guard 74*a* shown in FIGS. 6 and 6A does not have an inside cap 78. Rather, the corner is exposed. The inside corner guard 74*a* may be attached to the wall as discussed above in relation to FIGS. 5 and 5A.

The edge joint 26, horizontal joint 16 and the wainscot cap 52 may be leveled horizontally so that the stacked row of panels 14 are parallel to each other. The channels 32, 20 and 59 of the edge joint 26, horizontal joint 16 and the wainscot cap 52 allow the panels 14 to be shifted to the left or right to vertically align the panels so that the panels may have a checker board pattern. The panels 14 may also be vertically offset from each other to provide for different patterns. One or more shims 108 may be used to level the depth of the panels 14. As shown in the figures, one or more shims 108 may be disposed between the bases 90, 100, 66, 76 and the corresponding wall 12 to adjust the depth of the panel 14, as needed or desired. The shims 108 may have a through hole through which the screws 27 are inserted. The shims 108 may be located directly underneath the screws 27.

The panels 14 may be fabricated from an eco friendly material such as phenolic which is wood chips held together by resin. Other materials are also contemplated so long as they can be self supporting and withstand impact at about a ¼" thickness. The panels 14 may initially be provided in sheet form then cut to size. The panels 14 shown in the figures are shown as having identical thicknesses. However, it is also contemplated that panels 14 of different thicknesses may be mounted to the wall in different patterns to provide for a different aesthetic look. The panels 14 are also shown as being rectangular. However, it is also contemplated that the panels 14 may have other shapes such as octagonal, etc. so long as they have upper and lower ends that are parallel to each other and can be inserted into channels 32, 20 and 59. Additionally, each of the panels 14 may be fabricated from different materials in a unique pattern to provide for a unique aesthetic look.

The bottom edge joint 26 and the wainscot cap 52 are shown as extending across the entire row of panels 14. The vertical edge joint 26 extends the entire height of the stacked rows of panels 14 and abuts against the bottom edge joint 26 and the wainscot cap 52. The horizontal joint 16 is also shown as extending across the entire row of panels 14. The end of the horizontal joint 16 abuts the vertical edge joint 26. Vertical joints abut respective wainscot cap 52, horizontal joint 16 and bottom edge joint 26. Other configurations are also contemplated. By way of example and not limitation, the vertical edge joint 26 and the vertical joints 18 may extend along the entire height of stacked rows of panels 14 while the horizontal edge joint 26, horizontal joint 16 and the wainscot cap 52 abut the vertical edge joint 26 and the vertical joints 18.

The edge joint 26, horizontal wall clip 38, horizontal guide 42, upper cap 54, vertical joint 18, outside corner guard 64, 64*a*, cap 72, 72*a*, inside corner guard 74, 74*a* may be extruded out of aluminum or other suitable material. Other materials are also contemplated such as steel, plastic, etc. These components can be extruded in the shape shown and cut to length as the situation dictates or as desired. The components 38, 26, 64, 64*a*, 74, 74*a* may be attached to the wall 12 with one or more screws 27. These components 38, 26, 64, 64*a*, 74, 74*a* may have a plurality of holes along their lengths. The screws 27 may be inserted into the holes and secured to the wall 12 to attach these components 38, 26, 64, 64*a*, 74, 74*a* to the wall 12.

The system 10 described herein was described in relation to mounting of the system 10 to a vertical wall. However, it is also contemplated that the system 10 may be mounted to a wall oriented at a different angle such as skewed or horizontal (e.g., ceiling).

The wainscot wall panel system 10 discussed herein does not utilize glue or adhesive to mount the panels 14 to the wall 12. Rather, the panels 14 are received in channels 20, 22, 32 or 59. Since glue is not utilized to mount the panel 14 in the channel 20, 22, 32 and 59, air is allowed to seep through the backside of the panel 14. This equalizes the moisture or humidity levels between the front side and the back side of panel 14 to mitigate warping of the panel. Also, mold growth is mitigated and less toxic material is utilized.

The various embodiments disclosed herein include tongue and groove connections. However, it is also contemplated that the same embodiment may be modified so as to have an reverse configuration such as a groove and tongue connection.

The above description is given by way of example, and not limitation. Given the above disclosure, one skilled in the art could devise variations that are within the scope and spirit of the invention disclosed herein, including various ways of forming the various extruded components. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A wainscoting panel system for a wall, the system comprising:

a plurality of rigid panels defining a thickness;

a horizontal wall clip having a retaining wall;

a horizontal guide having a lower front retaining wall, an upper font retaining wall, and an upper rear retaining wall; and a plurality of vertical and horizontal joints attachable to the wall to mount the panels to the wall as rows and columns of panels, the horizontal joints having upper and lower channels, an inner width of the channels being equal to or greater than the thickness of the rigid panels for substaitially adhesive free nounting of the panels in the channels for providing air flow behind the rigid panels, the horizontal joints each comprising the horizontal guide and the horizontal wall clip, wherein the upper channel is defined by the upper front and rear retaining walls of the horizontal guide and the lower portion of a upper rigid panel receivable into the upper channel, and wherein the lower channel is defined by the lower front retaining wall of the horizontal guide and the retaining wall of the horizontal wall clip, an upper portion of a lower rigid panel receivable into the lower channel;

wherein the horizontal wall clip and the horizontal guide are interconnected with a vertically oriented tongue and groove connection, the tongue and groove connection being loose and laterally disposed between the wall and the rigid panel to allow vertical adjustment of the horizontal guide and allow the lower panel to support the upper panel.

2. The system of claim 1 wherein the panels are fabricated from phenol based binder material.

3. The system of claim 1 wherein the panels are rectangular.

4. The system of claim 1 wherein the horizontal joints comprise, a bottom edge joint the bottom edge joint defines a bottom edge joint base for attaching the bottom edge joint to the wall and the front and rear retaining walls which define the upper channel for receiving at least one of the rigid panels.

5. The system of claim 1 wherein the tongue of the horizontal guide and the groove of the horizontal wall clip have ribs, the tongue being loosely fitted in the groove for vertical adjustment of the horizontal guide, and the system further comprises silicone disposed between the ribbed tongues and ribbed grooves to hold the horizontal guide to the horizontal wall clip.

6. The system of Claim 1 further comprising a wainscot cap having:

a horizontal wall clip comprising a base and an upwardly directed groove;

an upper cap having a downwardly directed tongue which is received into the upwardly directed groove;

wherein the horizontal wall clip and the upper cap collectively define a lower channel for receiving a lower panel to finish the wainscot panel system.

7. The system of claim 6 wherein the tongue of the upper cap and the groove of the horizontal wall clip have ribs, the tongue being loosely fitted groove, and the system further comprises silicone disposed between the ribbed tongues and ribbed grooves to hold the upper cap to the horizontal wall clip.

8. The system of claim 1 wherein the rigid panels are ¼" thick or less,

9. The system of claim 1 wherein the groove of the vertically oriented tongue and groove connection is formed in the horizontal wall clip and the tongue of the vertically oriented tongue and groove connection is formed in the horizontal guide.

10. A method for installing a wainscot panel system according to claim 1 to a wall, the method comprising the steps of:

attaching, a bottom edge joint to the wall;

attaching a first horizontal wall clip to the wall above and parallel to the bottom edge joint;

inserting a first row of panels into a channel of the bottom edge joint;

attaching a first horizontal guide to the first horizontal wall clip and capturing the first row of panels in a lower channel defined by the first horizontal wall clip and the first horizontal guide;

optionally, adding at least one more row of panels and horizontal wall clips;

attaching an upper cap to the uppermost horizontal wall clip and capturing the uppermost row of panels in a. lower channel defined by the uppermost horizontal wall clip and the upper cap.

11. The method of claim 10 wherein the steps of attaching the first horizontal guide to the first horizontal wall clip and attaching the upper cap to the uppermost horizontal wall clip includes the steps of:

providing a ribbed groove on the horizontal will clip and ribbed tongue on the horizontal guide and the upper cap, the ribbed tongue loosely fitted to the ribbed groove;

disposing silicone into a groove of the horizontal wall clip;

inserting a tongue of the horizontal guide into the groove of the horizontal wall dip;

flowing silicone between ribs of the protrusion and tongue;

curing the silicone.

12. The method of claim 10 further comprising the steps of:

providing a vertical joint defining lateral channels;

inserting vertical edges of adjacent panels into the lateral channels.

* * * * *